US010490065B2

(12) United States Patent
Wong et al.

(10) Patent No.: US 10,490,065 B2
(45) Date of Patent: Nov. 26, 2019

(54) TRAFFIC MONITORING AND WARNING SENSOR UNITS

(71) Applicant: INTEL CORPORATION, Santa Clara, CA (US)

(72) Inventors: Hong W. Wong, Portland, OR (US); Jiancheng Tao, Shanghai (CN); Xianguo Liang, Shanghai (CN); Wah Yiu Kwong, Hillsboro, OR (US); Cheong W. Wong, Beaverton, OR (US)

(73) Assignee: INTEL CORPORATION, Santa Clara, CA (US)

( * ) Notice: Subject to any disclaimer, the term of this patent is extended or adjusted under 35 U.S.C. 154(b) by 0 days.

(21) Appl. No.: 15/755,410

(22) PCT Filed: Sep. 30, 2015

(86) PCT No.: PCT/CN2015/091200
§ 371 (c)(1),
(2) Date: Feb. 26, 2018

(87) PCT Pub. No.: WO2017/054162
PCT Pub. Date: Apr. 6, 2017

(65) Prior Publication Data

US 2018/0253964 A1 Sep. 6, 2018

(51) Int. Cl.
*G08G 1/01* (2006.01)
*G08G 1/04* (2006.01)
(Continued)

(52) U.S. Cl.
CPC ..... *G08G 1/0116* (2013.01); *G08G 1/0133* (2013.01); *G08G 1/0141* (2013.01);
(Continued)

(58) Field of Classification Search
CPC .. G08G 1/0116; G08G 1/0133; G08G 1/0141; G08G 1/04; G08G 1/042;
(Continued)

(56) References Cited

U.S. PATENT DOCUMENTS 6,602,021 B1 * 8/2003 Kim ..... E01F 9/559 116/63 R
2002/0008973 A1 * 1/2002 Boys ..... F21S 8/032 362/307
(Continued)

FOREIGN PATENT DOCUMENTS

CN 203530872 U 4/2014
CN 104243852 A 12/2014
(Continued)

OTHER PUBLICATIONS

PCT/CN2015/091200 International Preliminary Report on Patentability and Written Opinion of the International Searching Authority, dated Apr. 12, 2018 (6 pages).
(Continued)

*Primary Examiner* — Sisay Yacob
(74) *Attorney, Agent, or Firm* — Womble Bond Dickinson (US) LLP

(57) ABSTRACT

A traffic sensor unit (150, 250, 300, 400, 520, 522, 524, 770) for monitoring and warning is provided. The traffic sensor unit (150, 250, 300, 400, 520, 522, 524, 770) includes a processor, one or more sensors (310, 402) to sense motor vehicles (140, 240, 540, 542, 544, 546, 640, 645) and one or more alert strobes (330). The traffic sensor unit (150, 250, 300, 400, 520, 522, 524, 770) is to monitor sensor data generated by the one or more sensors (310, 402) and process the sensor data to detect a traffic condition (100, 200), determine a traffic state of a plurality of traffic states based at least in part on the sensor data and enable or disable one
(Continued)

or more alert strobes (330) based at least in part on the determined traffic state.

23 Claims, 8 Drawing Sheets

(51) Int. Cl.
*G08G 1/042* (2006.01)
*G08G 1/052* (2006.01)
*G08G 1/095* (2006.01)
*G08G 1/0967* (2006.01)

(52) U.S. Cl.
CPC ..... *G08G 1/04* (2013.01); *G08G 1/042* (2013.01); *G08G 1/052* (2013.01); *G08G 1/095* (2013.01); *G08G 1/096716* (2013.01); *G08G 1/096758* (2013.01); *G08G 1/096783* (2013.01)

(58) Field of Classification Search
CPC .. G08G 1/052; G08G 1/095; G08G 1/096716; G08G 1/096758; G08G 1/096783
See application file for complete search history.

(56) References Cited

U.S. PATENT DOCUMENTS

2004/0130463 A1* 7/2004 Bloomquist ..... G08G 1/096716 340/907
2004/0183694 A1 9/2004 Bauer
2005/0270175 A1* 12/2005 Peddie ..... G08G 1/096783 340/907
2006/0193691 A1* 8/2006 Gonzalez ..... E01F 9/559 404/15
2011/0035140 A1* 2/2011 Candy ..... G08G 1/04 701/119
2013/0063282 A1* 3/2013 Baldwin ..... B61L 29/282 340/941

FOREIGN PATENT DOCUMENTS

CN 104517449 A 4/2015
CN 204496709 U 7/2015
CN 104896394 A 9/2015
JP 2014238656 A 12/2014

OTHER PUBLICATIONS

State IP Office of the P.R. China, International Search Report of the International Searching Authority, dated Jun. 29, 2016 for International Application No. PCT/CN2015/091200 (4 pgs).
State IP Office of the P.R. China, Written Opinion of the International Searching Authority, dated Jun. 29, 2016 for International Application No. PCT/CN2015/091200 (4 pgs).

* cited by examiner

TRAFFIC MONITORING AND WARNING SENSOR UNITS

CROSS-REFERENCE TO RELATED APPLICATIONS

This patent application is a U.S. National Phase application under 35 U.S.C. § 371 of International Application No. PCT/CN2015/091200, filed on 30 Sep. 2015, entitled TRAFFIC MONITORING AND WARNING SENSOR UNITS, incorporated herewith in its entirety.

TECHNICAL FIELD

Embodiments described herein generally relate to the field of electronic devices and, more particularly, to traffic monitoring and warning sensor units.

BACKGROUND

Despite significant advances in vehicle and highway safety, traffic accidents continue to cause many injuries and deaths. Among the dangers are rapid changes in weather and road conditions that may cause huge multi-car accidents because drivers are unable to react quickly enough to slow down or avoid the other vehicles, thus causing a chain reaction or pile-up accident. For instance, weather conditions such as snow, ice, fog, hail, and heavy rain can create extremely dangerous conditions in a very short amount of time. Further, conditions in good weather such as smoke from field burning can quickly create a very dangerous condition that results in a traffic pile up.

While forms of road condition monitoring and warnings exist, such as cameras to view highway conditions and overhead signs to report conditions, these often do not provide detection and warning of dangerous condition quickly enough when conditions are changing rapidly. Further, technology such as cameras can be obstructed by weather conditions, thus making them unusable.

Outside of urban areas, the detection and warning of dangerous conditions are even less effective as the cost of installing and monitoring system discourage governmental entities from instituting such systems, and limited communications lessen the effectiveness of systems that do exist.

BRIEF DESCRIPTION OF THE DRAWINGS

Embodiments described here are illustrated by way of example, and not by way of limitation, in the figures of the accompanying drawings in which like reference numerals refer to similar elements.

DETAILED DESCRIPTION

Figure 1:
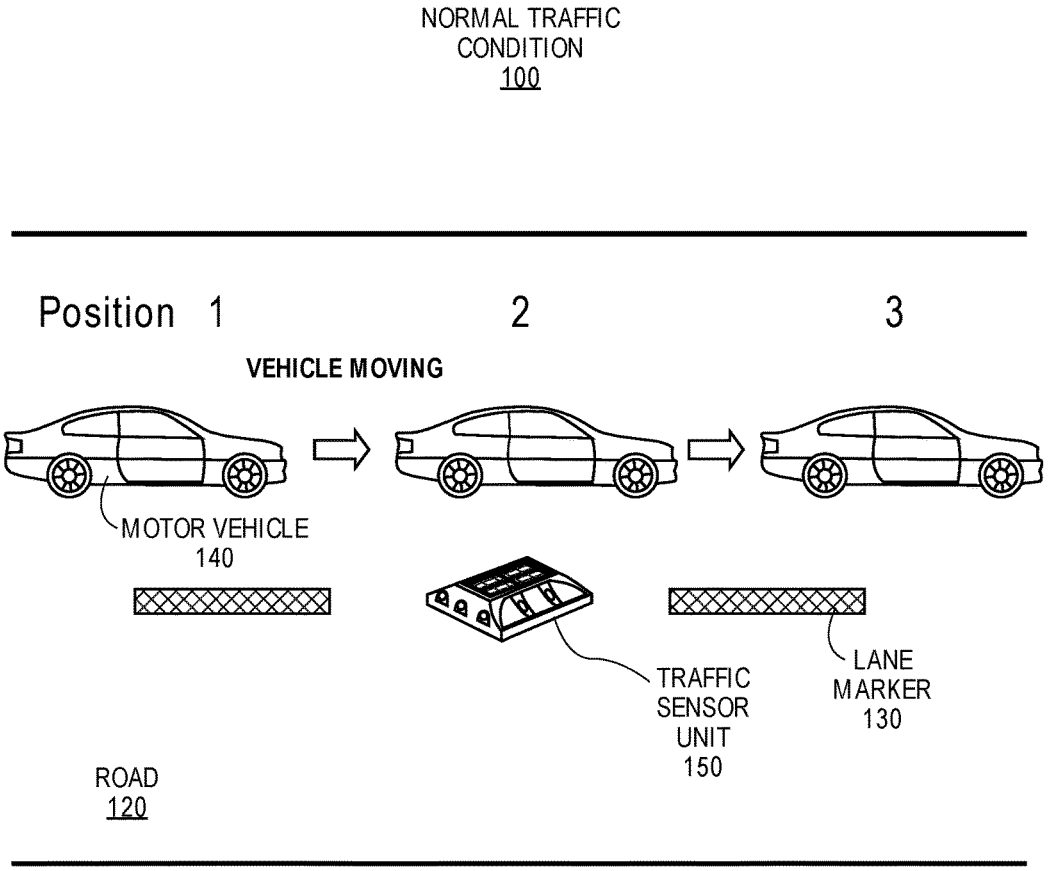
FIG. 1 is an illustration of operation of a traffic sensor unit in normal traffic conditions according to an embodiment.

Embodiments described herein are generally directed to traffic monitoring and warning sensor units.

For the purposes of this description:

"Road" or "roadway" means any highway, freeway, expressway, turnpike, bridge, street, or other road for the use of motor vehicles.

"Motor vehicle" means any motorized vehicle that is utilized on a road, including, but not limited to, an automobile, a truck, a semi with one or more trailers, or a motorcycle. Motor vehicles include vehicles that that share or cross a roadway, including trains on tracks that cross a roadway.

In some embodiments, a network enabled road conditions monitoring and safety advisory system includes multiple traffic monitoring and warning sensor units (referred to herein as traffic sensor units) that are linked by a wireless network connection. In some embodiments, the traffic sensor units are connected to the Internet of Things (IoT), which has been defined as a global infrastructure for the information society, enabling advanced services by interconnecting (physical and virtual) things based on existing and evolving interoperable information and communication technologies. In some embodiments, an apparatus or system may utilize LoRa™ Technology, where LoRaWAN is a Low Power Wide Area Network (LPWAN) specification intended for wireless battery operated Things in a network. However, embodiments are not limited to a particular communication or network architecture.

In some embodiments, an apparatus, system, or process provides an advanced traffic monitoring and warning operation to minimize the risk of multi-vehicle accidents, referred to as motor vehicle pile ups, on highways and other roads. In some embodiments, an apparatus, system, and method further applies to other circumstance, including road surface conditions, such as black ice, oil spill, flooding, and other such conditions.

In some embodiments, an apparatus, system, or process allows for alerting drivers to assist in preventing traffic accidents. While self-driving vehicles are being implemented and may be able to detect and avoid dangerous conditions much more quickly than human drivers, it appears likely that self-driving vehicles and human-piloted vehicles will share the same roads for many years, and thus systems to avoid mass accidents will be needed for many years. Further, self-driving vehicles may be implemented slowly in less wealthy nations, which thus may be expected to continue to rely on existing vehicle technology into the future. In some embodiments, traffic sensor units allow for low cost installation and operation that may exist in conjunction with existing and future traffic control technology to provide rapid and effective alerts (flashing/strobe light) to drivers regarding dangerous conditions that are ahead on the road.

In some embodiments, an apparatus, system, or process includes the following operations:

(1) Sensor operation: In some embodiments, multiple traffic sensor units are utilized to monitor traffic flow, and alert drivers when the traffic is slowing down or stops. In some embodiments, traffic sensor units are installed on a road (including installation of some units at least partially below the surface of the road) or near the road. In some embodiments, each traffic sensor unit includes one or more sensors (which may also be referred to herein as traffic sensors), including magnetic and thermal sensors.

In some embodiments, traffic conditions are detected based on a rate of change of sensor data. In operation, normal traffic conditions include vehicles generally traveling at or above a certain speed. Thus, when vehicles are moving, sensor data collected by an embodiment of a traffic sensor unit is continually changing. The continuous changing of sensor data indicates a normal road state. It is noted that a normal road state may also include periods in which there are no motor vehicles within sensor range, such as in circumstances in which an isolated road has little traffic, and occasional vehicles that operate more slowly than normal, such as the movement of an oversize vehicle.

Circumstances in which one or more motor vehicles are stalled or stopped on the road or are moving abnormally slowly on the road may indicate an abnormal traffic condition. When vehicles are not moving, sensor data collected is not changing (because cars are not moving) or is changing slower than normal. This indicates an abnormal traffic condition, and may result in triggering an alert traffic state. Abnormal traffic conditions may further include, for example, a train that is stopped across a roadway.

In some embodiments, alert traffic states may include more than one urgency levels. For instance, gradually slowing traffic may result in a first alert traffic state, wherein the first alert traffic state may be a warning state, while quickly slowing or stopped traffic may result in a second alert traffic state, wherein the second alert traffic state may be an emergency state. However, embodiments are not limited to any particular number of traffic states.

(2) Communication Operation: In some embodiments, a traffic sensor unit further includes a transmitter and receiver to communicate messages with other sensor units. In some embodiments, a traffic sensor unit may further communicate with a central traffic control station, if such station is present. However, a system including a plurality of traffic sensor units may operate independently without control by a central traffic control. Stated in another manner, a system may include the installation of traffic sensor units, with such units then operating in communication with each other without requiring any outside control of each traffic sensor unit. In some embodiments, each traffic sensor unit is to operate independently as a standalone unit.

(3) Alert operation: In some embodiments, in an alert traffic state, one or more traffic sensor units turn on one or more alert strobes to alert drivers that traffic has slowed down or stopped. Alert strobes may vary based on a level of alert traffic state. For example, a warning state may result in a warning strobe operation (a first alert operation), where the warning strobe operation may, for example, include a first strobe color (such as amber) and a first strobe pattern (such as a steady light or a slowly flashing strobe). Further, an emergency state may result in an emergency alert strobe operation (a second alert operation), where the emergency alert strobe operation may include, for example, a second strobe color (such as red) and a second strobe pattern (such as a quickly flashing strobe).

FIG. 1 is an illustration of operation of a traffic sensor unit in normal traffic conditions according to an embodiment. In some embodiments, a traffic sensor unit 150 is installed on a the surface of a road 120, or otherwise near to the road 120 to sense the presence or motion of motor vehicles, such as motor vehicle 140. In this illustration, the traffic sensor unit 150 is installed on the surface of the road 120 along lane markers 130 that divide the road surface into lanes. The traffic sensor unit 150 may be one of many traffic sensor units in a traffic monitoring and warning system.

In some embodiments, if the motor vehicle 140 continues to move at a normal pace, such as a motion from position 1 to position 2 to position 3 at a speed of at least a certain minimum threshold, then the traffic sensor unit 150 will detect sensor data that is continually changing at a certain rate and may conclude that there are normal traffic conditions 100 at the location of the traffic sensor unit based at least in part on the rate of change of the sensor data. Thus, it is not necessary for the traffic sensor unit to detect specific motor vehicles, but rather may only detect a rate of change in sensor data.

In some embodiments:

(a) An apparatus is a smart traffic sensor unit with sensing capability, which may include infrared (thermal) sensing capability, magnetic field sensing capability, or both, and status reporting capability, which utilizes wireless technology and local warning strobes on the traffic sensor unit.

(b) When cars are slowing down, or stopped due to unforeseen road or weather conditions, the traffic sensor unit will detect the traffic flow condition, and turn on the visual warning display (such as turning on a flashing red strobe on the housing of the traffic sensor unit), to warn the drivers of oncoming motor vehicle traffic to slow down or stop.

(c) In some embodiments, in parallel with the visual warning display, a traffic sensor unit is further operable to broadcast the road conditions and alert vehicles equipped with smart devices, such as smart watches, smart phones, and in-vehicle information systems.

(d) In some embodiments, a traffic sensor unit is further operable to provide road status wirelessly to a central traffic control. In some embodiments, the central traffic control is able to remotely turn on/off an alert on the traffic sensor units of a system.

Figure 2:
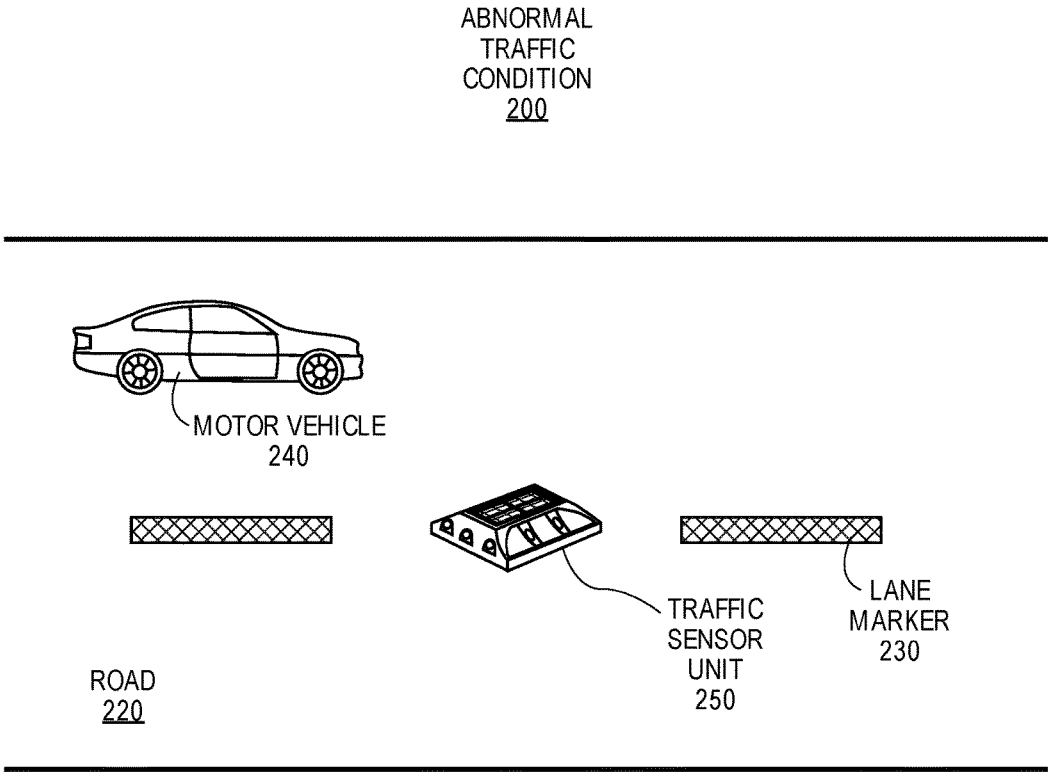
FIG. 2 is an illustration of operation of a traffic sensor unit in abnormal traffic conditions according to an embodiment.

FIG. 2 is an illustration of operation of a traffic sensor unit in abnormal traffic conditions according to an embodiment. In some embodiments, a traffic sensor unit 250 is installed on the surface of a road 220, or otherwise near to the road 220 to sense the presence or motion of motor vehicles, such as motor vehicle 240. In this illustration, the traffic sensor unit 250 is installed on the surface of the road 220 along lane markers 230 that divide the road surface into lanes. The traffic sensor unit 250 may be one of many traffic sensor units in a traffic monitoring and warning system.

In some embodiments, if the motor vehicle 240 is stopped or travels at an abnormally slow pace, then the traffic sensor unit 250 will detect sensor data that is not changing or is changing at a pace that is too slow for normal conditions, and may conclude that there are abnormal traffic conditions 200 at the location of the traffic sensor unit.

Figure 3:
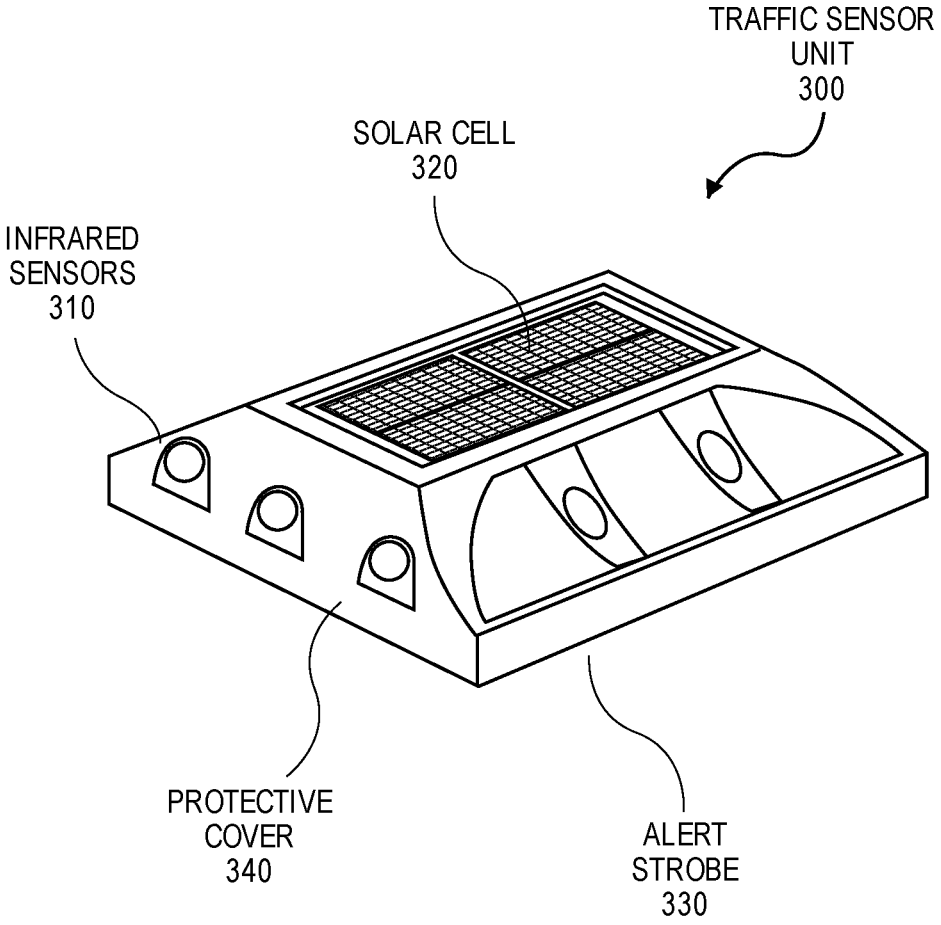
FIG. 3 illustrates a traffic sensor unit according to an embodiment.

FIG. 3 illustrates a traffic sensor unit according to an embodiment. In some embodiments, the traffic sensor unit 300 is constructed to be installed in a roadway and to withstand harsh environmental conditions. Further, the traffic sensor unit 300 is to operate as a self-contained unit without regarding commands to operate. The traffic sensor 300 may be, for example, traffic sensor unit 150 illustrated in FIG. 1 or traffic sensor unit 250 illustrated in FIG. 2.

In some embodiments, the traffic sensor unit 300 includes one or more sensors, which may include, but is not limited to, infrared sensors 310. In some embodiments, the traffic sensor unit 300 further includes a power production component or means, which may include, but it not limited to, a solar cell 320; and an alert mechanism, which may include, but is not limited to, an alert strobe 330. In some embodiments, the unit 300 includes protective case 340 to protect the unit from impact from motor vehicles and harsh environmental conditions on a roadway.

In some embodiments, a traffic sensor unit 300 is designed and implemented to warn drivers regarding dangerous traffic conditions. In some embodiments:

(1) A traffic sensor unit includes one or more sensors, wherein the sensors may include, but are not limited to:

(a) A magnetometer to sense a change of magnetic field (due to the proximity of motor vehicles); or (b) A thermal/infrared sensor to sense the change or movement of heat sources from the motor vehicle engines. In some embodiments, the one or more sensors may include multiple thermal sensors, wherein one or more thermal sensors are to monitor the traffic and one more thermal sensors are to monitor the environment, such as monitoring a temperature of the road to set up a base line for the detected thermal information. In the operation of a traffic sensor unit, the temperature of the road can vary greatly depending on the current weather conditions and time of day. In one example, one thermal sensor of a traffic sensor unit is operable to monitor the environment, while the remaining one or more thermal sensors of the traffic sensor unit are operable to monitor thermal readings from motor vehicles. In this manner, the sensed environment thermal data may be utilized to assist in differentiating the temperatures of motor vehicles from the temperature of the road.

(2) A traffic sensor unit further includes embedded processor capability to monitor the rate of change of sensor data, such as change in a magnetic field or movement of infrared heat sources. Further, the embedded processor includes capability to monitor received message transmissions. In some embodiments, the processor is operable to determine a traffic state based on the sensor data and received messages.

(3) A traffic sensor unit further includes communication capability to transmit traffic alert messages via a wireless connection to other traffic sensor units and to a central traffic control station, as needed. In some embodiments, communications may include a location of the traffic sensor unit, where a location may include, but is not limited to, a highway mile value for the location (equivalent to mileage markers for a roadway).

In some embodiments, a traffic sensor unit further includes capability of receiving traffic alert messages via the wireless connection from other traffic sensor units and from a central traffic control station. In some embodiments, a traffic sensor unit is operable to obtain location information, such as highway mile values, from received messages, and utilize such data to determine whether received messages are relevant to the location of the traffic sensor unit.

(4) A traffic sensor unit includes one or more embedded strobe lights to alert drivers on the road of alert conditions. The strobe lights may include, but are not limited to, lights of varying colors and strobe patterns.

(5) A traffic sensor unit includes ability to generate power from environmental condition and storage capacity to store power to run the sensor unit. Power generation sources may include, but are not limited to, one or more of:

(a) Solar power generation from sunlight;

(b) Thermal harvesting to generate power from road heat; and (c) Generation of energy from road vibration of the road.

(6) A traffic sensor unit is designed and constructed to harsh environmental conditions. In some embodiments, the sensor unit is waterproof and constructed to withstand impacts of motor vehicle traffic.

In some embodiments, a central traffic control station may provide alerts to traffic sensor units. For example, if certain conditions are detected, such as an oil spill on the roadway, that creates a need to alert drivers to slow down or stop, the highway control center can remotely turn on the warning light strobe on the traffic sensor units, with corresponding colors to advise drivers to slow down or stop. In some embodiments, a traffic sensor unit is capable of receiving traffic alert messages from the central traffic control station, responding to the traffic alert message, and re-transmitting the traffic alert message to other traffic sensor units.

In some embodiments, a traffic sensor unit can further broadcast traffic advisory messages for the use of motor vehicle operation. In an example, a smart car operating system, such as a smart phone, in-car navigating system, may utilize the broadcast traffic advisory messages to take safety actions. In some embodiments, the broadcast of such traffic advisory messages may be provided in addition to the warning light/strobes provided by the traffic sensor unit. In some embodiments, a broadcast traffic advisory message may include more detailed information than is expressed by the warning strobes, such as, for example, whether the driver should stop the car, or should reduce vehicle speed to a certain recommended safe travel speed. In some embodiments, the traffic sensor unit may calculate the safe travel speed and broadcast such information.

In some embodiments, a traffic sensor unit is capable of providing real time traffic alerts because the traffic sensor unit is providing immediate response to current traffic conditions based at least in part on traffic sensor data. As a result, drivers can receive visual alerts very rapidly, thus allowing time to respond to the alert conditions.

In some embodiments, a traffic sensor unit may provide for simple and reliable operation in harsh weather conditions. In some embodiments, the traffic sensor unit is self-controlled, wherein, for example, upon detecting a pre-set sensor conditions, the traffic sensor unit will broadcast the condition to the peer traffic sensor units near-by, and will turn on the alert strobes without requiring support from a central traffic control. In some embodiments, based on the road condition, a traffic sensor unit will turn on alert strobes to a certain range of devices (such as, for example, to one mile ahead of the site of an accident or other abnormal condition) to allow drivers to have sufficient time to slow down or stop their motor vehicles. In some embodiments, a traffic sensor unit may further turn on a lower urgency alert strobe if, for example, the unit is further from the accident site (such as more than one mile but less than two miles) or is located on an opposite side of a divided highway from the accident or other abnormal condition.

Figure 4:
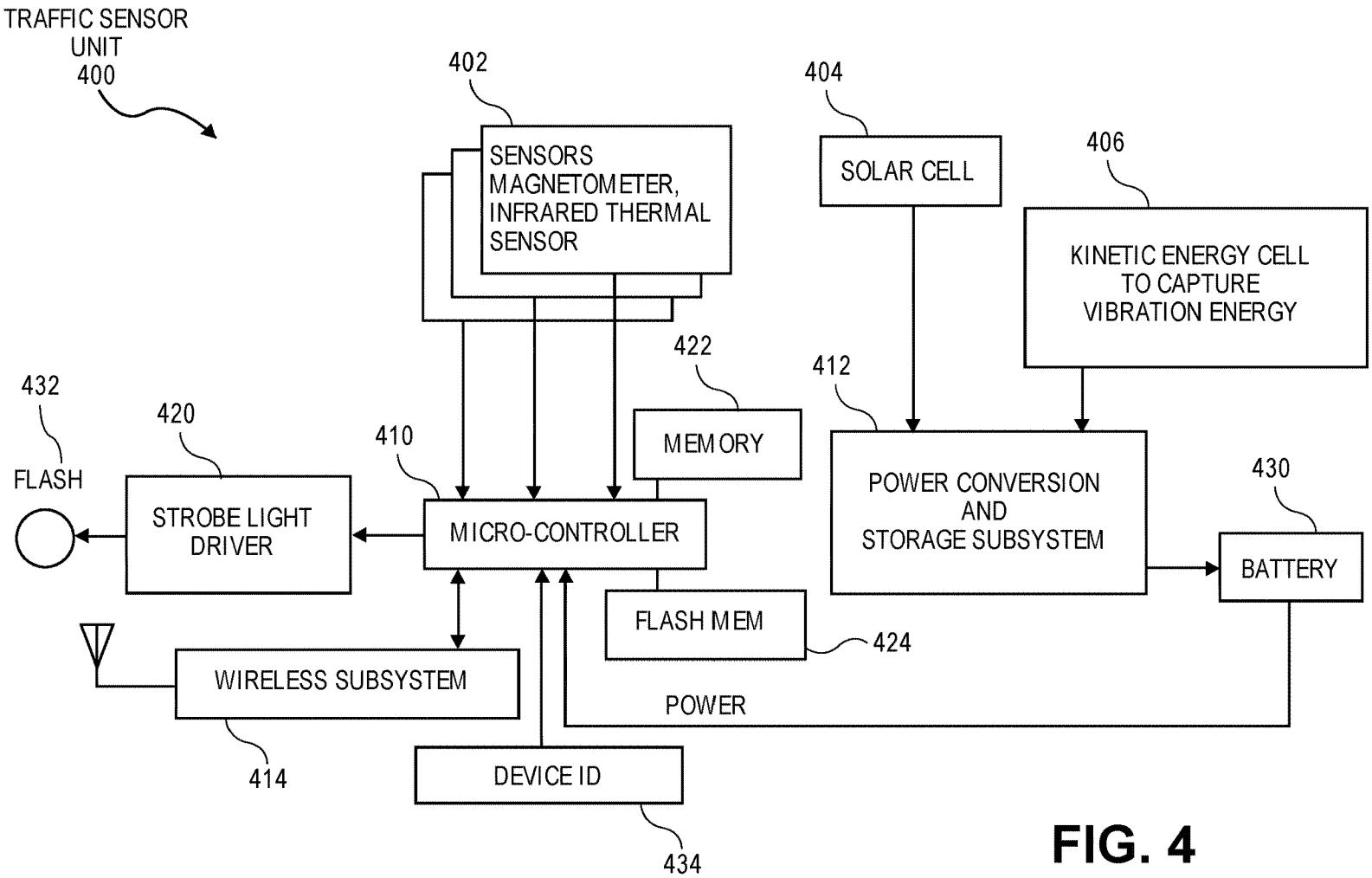
FIG. 4 illustrates components of a traffic sensor unit according to an embodiment.

FIG. 4 illustrates components of a traffic sensor unit according to an embodiment. In some embodiments, the traffic sensor unit 400 (such as traffic sensor unit 300 illustrated in FIG. 3) includes one or more sensors 402, which may include an infrared sensor, magnetometer sensor, or both, and includes a power generation component, which may include a solar cell 404, a kinetic energy cell 406 to capture vibration energy from the roadway, or both.

In some embodiments, the traffic sensor unit 400 further includes a microcontroller 410 to control operation of the unit; a power conversion and storage subsystem 412 and battery 430 to generate and store power; and a wireless subsystem 414 to transmit and receive traffic alert messages to and from other traffic sensor units and to and from a central traffic control. In some embodiments, the traffic sensor unit includes a device identification (ID) 434, wherein each traffic sensor unit may be assigned a unique identification. The device identification 434 may be utilized in, for example, self-health checking in which a traffic sensor unit may transmit a message regarding a hardware failure or other issue, with a message including the device ID; remote health device checking, where devices may (if operational) respond to a health inquiry with a response that includes the device ID; assistance with detection of improper tampering with traffic sensor units by allowing for a check of the identity and location of each traffic sensor unit; or other uses in which an identification of each traffic sensor unit will assist in the operation of a traffic control system. In some embodiments, the device ID may also be used for remote system/device management and software/firmware upgrade.

In some embodiments, the traffic sensor unit 400 further includes a strobe light driver 420 to provide an alert strobe signal, the strobe signal to be generated by one or more flash (light) units 432 to warn drivers of abnormal traffic conditions. In some embodiments, the traffic sensor unit further includes a memory 420 (such as dynamic random access memory (DRAM) or other system memory, to store data during operation, and a nonvolatile memory such as flash memory 424 to hold data, including, for example, program data and identity or location data for the traffic sensor unit 400. The traffic sensor unit may include other forms of memory as well, such as read only memory (ROM) or other data storage components.

In some embodiments, the traffic sensor unit 400 may include a state machine, wherein the states of the state machine may include a normal state and one or more alert states, which may include, but are not limited to, a warning alert state and an emergency alert state.

Figure 5:
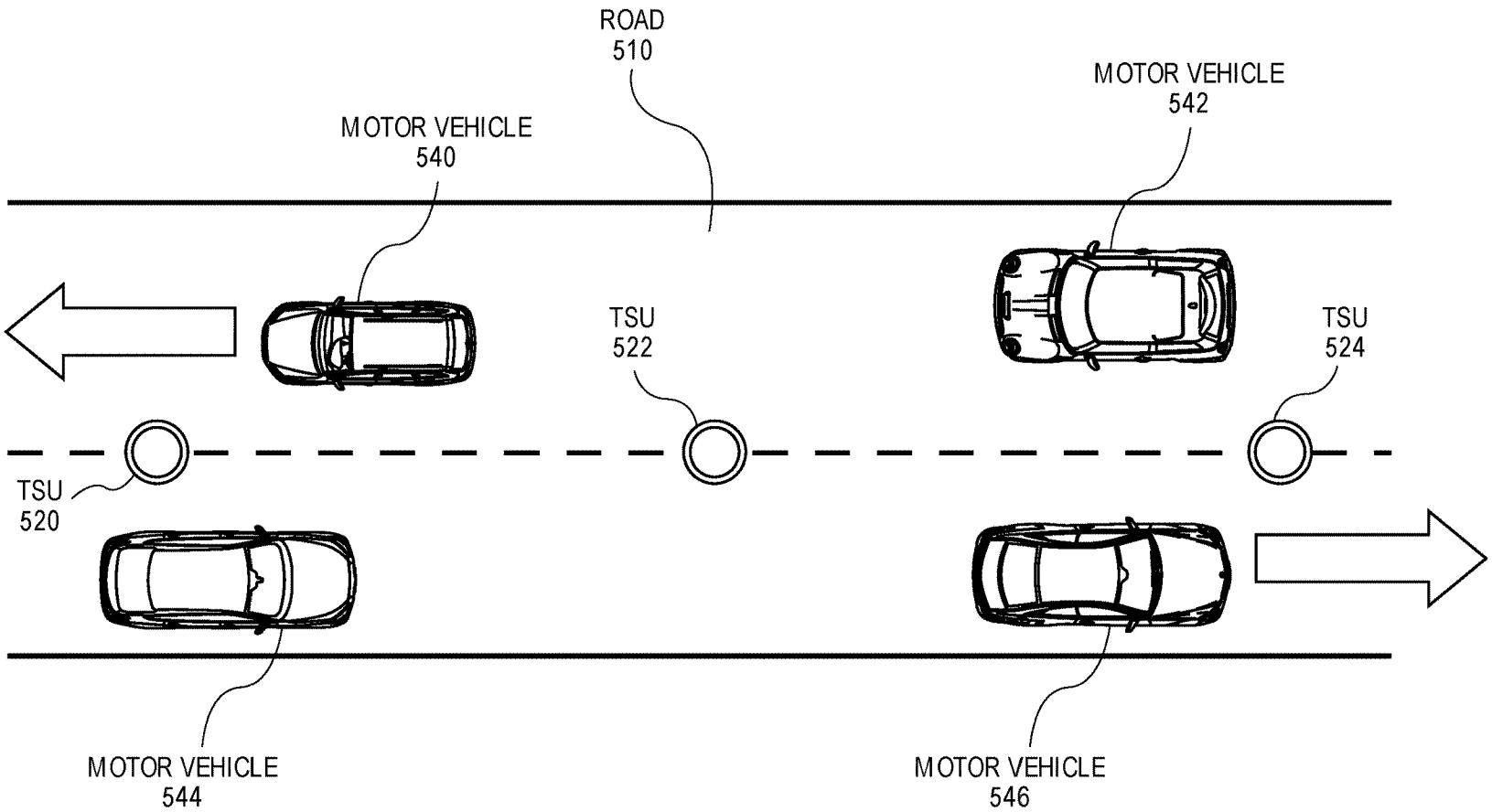
FIG. 5 illustrates operation of a set of traffic sensor units according to an embodiment.

FIG. 5 illustrates operation of a set of traffic sensor units according to an embodiment. In some embodiments, a set of traffic sensor units, illustrated as TSU 520, TSU 522, and TSU 524, are to monitor the traffic conditions of a road 510, wherein each of the traffic sensor units includes one or more traffic sensors. The traffic sensor units 520-524 may be traffic sensor units as illustrated in FIGS. 3 and 4. In FIG. 5, the traffic sensor units are arranged in the middle of a two-way street, where motor vehicles 540 and 542 are travelling in a first direction and motor vehicles 544 and 546 are traveling in a second opposite direction. In some embodiments, the traffic sensor units 520-524 are operable to monitor traffic in both directions on the road 510. However, in other implementations a traffic sensor unit may be operable to monitor traffic in a single direction, depending on the placement of the unit and the lane structure of the road 510.

In some embodiments, the traffic sensor units 520-524 are operable to transmit and receive traffic alert messages to and from other traffic sensor units and to and from a central traffic control station. In some embodiments, each traffic sensor unit is operable to transmit traffic alert messages including, but not limited to, an alert regarding an abnormal condition and a location of the abnormal condition. In some embodiments, each traffic sensor unit is operable to determine traffic state based on at least sensor data, and may further determine a traffic state based on received traffic alert messages.

In some embodiments, each traffic sensor unit is operable to provide alert strobes in response to a current alert traffic state. In some embodiments, each traffic sensor unit may further be operable to transmit traffic advisory messages for receipt by smart devices of motor vehicle occupants or by in-vehicle navigation devices.

Figure 6:
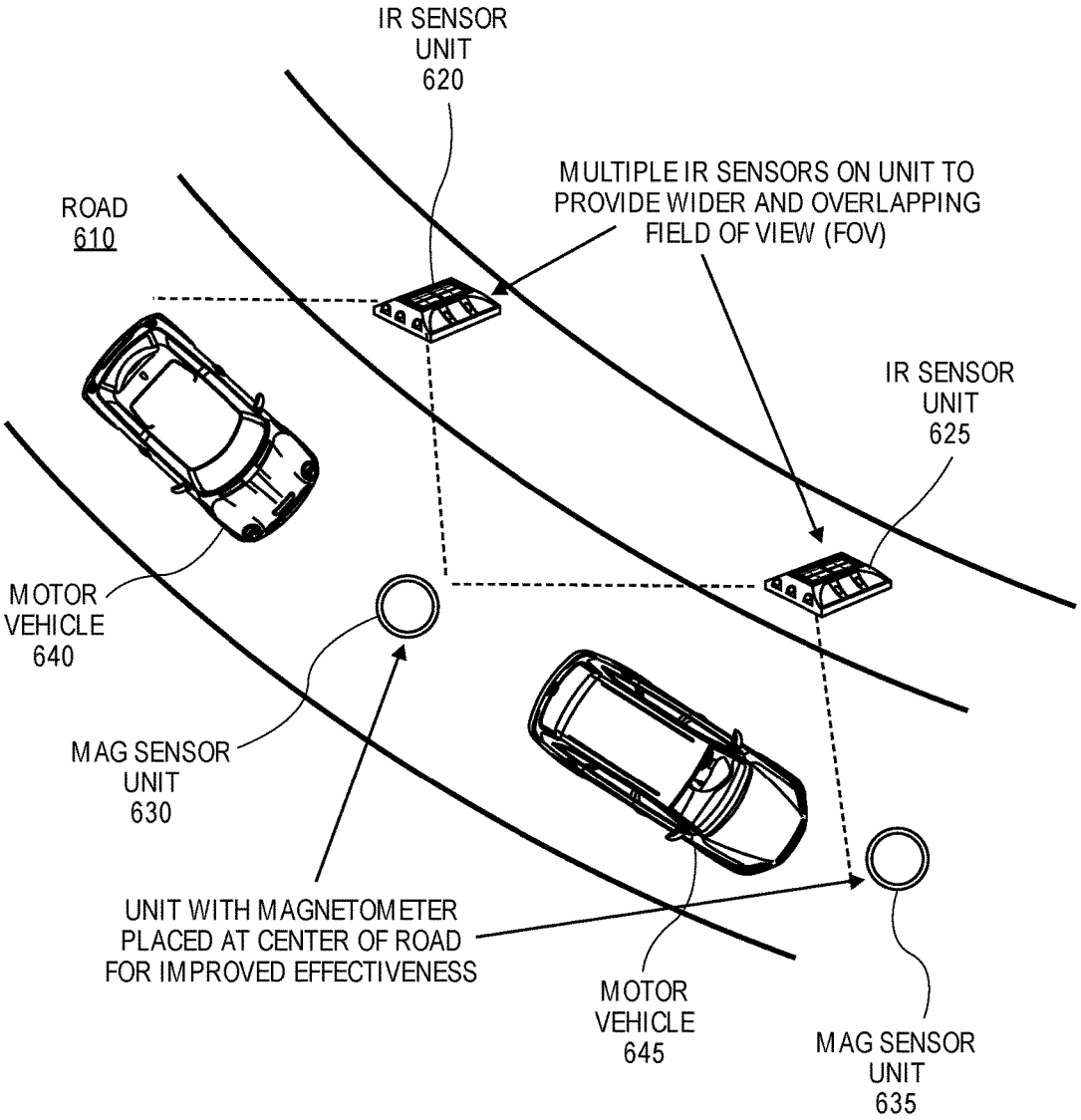
FIG. 6 illustrates operation of a set of infrared sensor units and a set of magnetometer sensing units according to an embodiment.

FIG. 6 illustrates operation of a set of infrared sensor units and a set of magnetometer sensing units according to an embodiment. In some embodiments, a set of traffic sensor units may include a first set of units containing a first type of sensor and a second set of units containing a second different type of sensor. For example, a set of traffic sensor units may include a first set of IR sensor units, such as IR sensor unit 620 and IR sensor unit 625 (which may provide additional sensing effectiveness if placed at or near a road center such motor vehicles pass over the traffic sensor units), and a second set of magnetometer sensor units, such as magnetometer sensor unit 630 and magnetometer sensor unit 635 (which may provide additional sensing effective new if placed to a side of vehicular traffic to allow for a wider and overlapping field of view). As illustrated in FIG. 6, the first set of IR sensor units 620-625 and the second set of sensor units 630-635, operate to detect traffic conditions on road 610, including detection of movement of motor vehicles 640 and 645. In some embodiments, either or both of the traffic sensor units of the first and second sets of traffic sensor units include strobe lights to provide alert signals.

Figure 7:
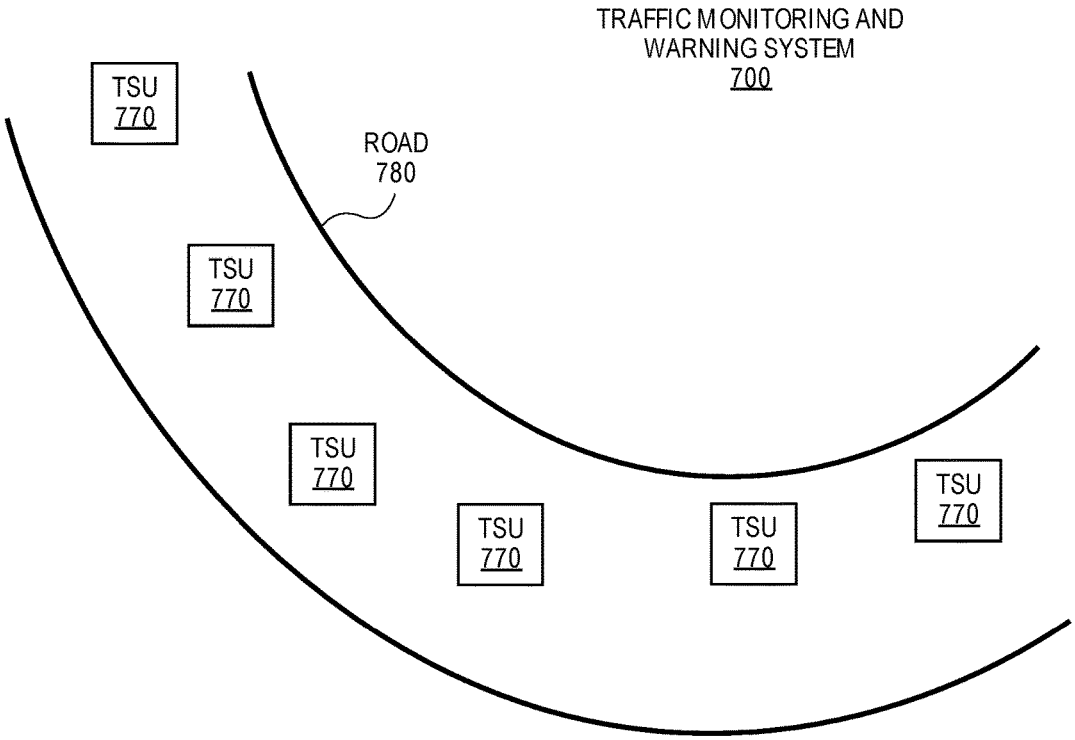
FIG. 7 illustrates a traffic monitoring and warning system according to an embodiment.
Figure 7:
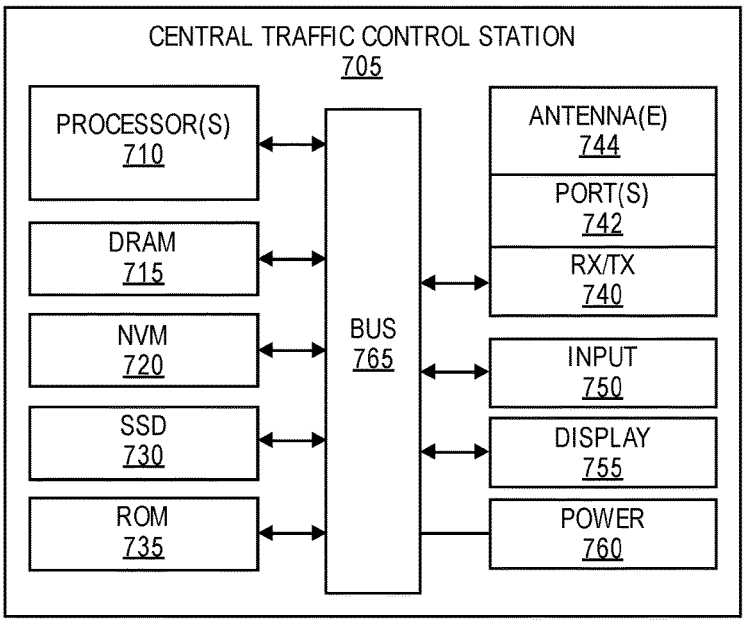

FIG. 7 illustrates a traffic monitoring and warning system according to an embodiment. In some embodiments, a traffic monitoring and waning system includes a set of traffic sensor units 770 that are installed on a road 780. In some embodiments, the traffic sensor units 770 may be as illustrated in FIGS. 3 and 4.

In some embodiments, the system may further include one or more central traffic control stations 705 (which may be referred to herein as a station), wherein the station 705 is operable to wirelessly transmit and receive traffic alert messages with the one or more of the traffic sensor units 770. However, the traffic sensor units 770 may operate independently of the station 705, and the system 700 does not require inclusion of central traffic control.

In this illustration, certain standard and well-known components that are not germane to the present description are not shown. Elements shown as separate elements may be combined, including, for example, an SoC (System on Chip) combining multiple elements on a single chip. In some embodiments, the station 705 may be linked by a wireless connection with at least one of the traffic sensor units 770. In some embodiments, the station 705 may include a processing means such as one or more processors 710 coupled to one or more buses or interconnects, shown in general as bus 765. The processors 710 may comprise one or more physical processors and one or more logical processors. In some embodiments, the processors 710 may include one or more general-purpose processors or special-processor processors.

The bus 765 is a communication means for transmission of data. The bus 765 is illustrated as a single bus for simplicity, but may represent multiple different interconnects or buses and the component connections to such interconnects or buses may vary. The bus 765 shown in FIG. 7 is an abstraction that represents any one or more separate physical buses, point-to-point connections, or both connected by appropriate bridges, adapters, or controllers.

In some embodiments, the station 705 further comprises dynamic random access memory (DRAM) or other dynamic storage device or element as a main memory 715 for storing information and instructions to be executed by the processors 710.

The station 705 also may comprise a non-volatile memory (NVM) 720; a storage device such as a solid state drive (SSD) 730; and a read only memory (ROM) 735 or other static storage device for storing static information and instructions for the processors 710.

In some embodiments, the station 705 includes one or more transmitters or receivers 740 coupled to the bus 765.

In some embodiments, the handheld device 705 may include one or more antennae 744, such as dipole or monopole antennae, for the transmission and reception of data via wireless communication using a wireless transmitter, receiver, or both, and one or more ports 742 for the transmission and reception of data via wired communications. Wireless communication includes, but is not limited to, Wi-Fi, Bluetooth™, near field communication, and other wireless communication standards. Wired or wireless communications may include communications with the traffic sensor units 770. In some embodiments, the traffic sensor units 770 and central traffic control station 705 may be linked utilizing Internet of Things technology.

In some embodiments, station 705 includes one or more input devices 750 for the input of data, including hard and soft buttons, a joy stick, a mouse or other pointing device, a keyboard, voice command system, or gesture recognition system. In some embodiments, the handheld device 705 includes an output display 755, where the display 755 may include a liquid crystal display (LCD) or any other display technology, for displaying information or content to a user. In some environments, the display 755 may include a touch-screen that is also utilized as at least a part of an input device 750. Output display 755 may further include audio output, including one or more speakers, audio output jacks, or other audio, and other output to an operator.

The station 705 may also comprise a battery or other power source 760, which may include a solar cell, a fuel cell, a charged capacitor, near field inductive coupling, or other system or device for providing or generating power in the handheld device 705. The power provided by the power source 760 may be distributed as required to elements of the station 705.

Figure 8:
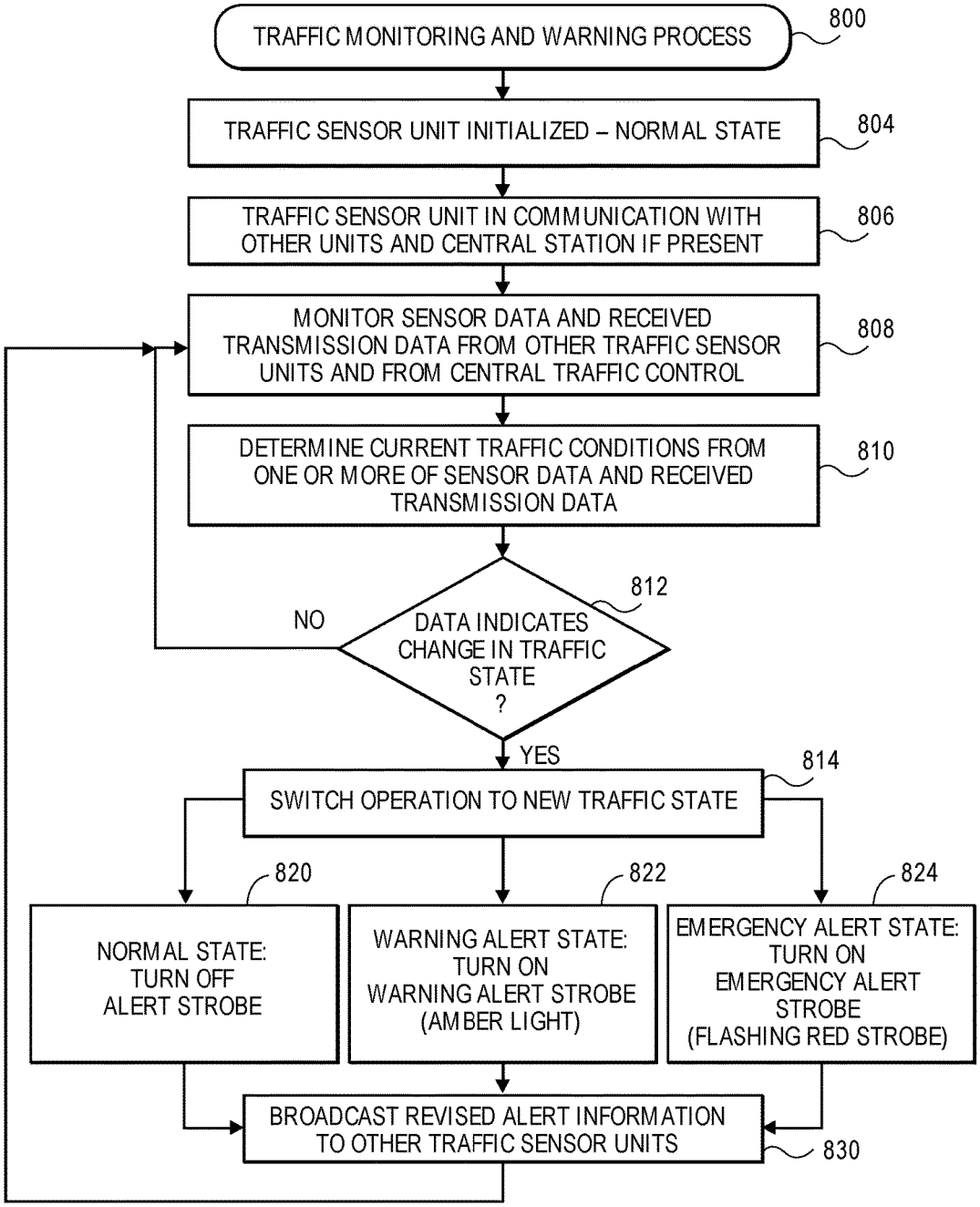
FIG. 8 is a flowchart to illustrate a traffic monitoring and warning process according to an embodiment.

FIG. 8 is a flowchart to illustrate a traffic monitoring and warning process 800 according to an embodiment. In some embodiments, the process 800 may include initializing a traffic sensor unit 804, which may include initializing the traffic sensor unit in a normal state, wherein the traffic sensor unit includes a normal state and one or more alert states. In some embodiments, the traffic sensor unit may be as illustrates in FIGS. 3 and 4. In some embodiments, the traffic sensor unit is in communication with other traffic sensor units and, if present, one or more central traffic control stations 806, such as station 705 illustrated in FIG. 7.

In some embodiments, the traffic sensor unit is to monitor sensor data from one or more sensors (such as an infrared sensor, a magnetometer sensor, or both) and to monitor received transmission data from other traffic sensor units and, if present, from one or more central traffic control stations 808. In some embodiments, the traffic sensor unit is to determine current traffic conditions from one or more of sensor data and received transmissions 810.

In some embodiments, if the data does not indicate a change in alert state 812, the process continues with monitoring of sensor data and received transmission data 808. If the data indicates a change in traffic state 812, then the traffic sensor unit is to switch to a new traffic state 814.

In some embodiments, if the new traffic state is the normal state, the traffic sensor unit is to turn off any alert strobe lights 820. In some embodiments, if the new traffic state is a warning alert state, the traffic sensor unit is to turn on a warning alert strobe, such as a solid or flashing amber light 822. In some embodiments, if the new traffic state is an emergency alert state, the traffic sensor unit is to turn on an emergency alert strobe, such as a flashing red light 824. While three traffic states are illustrated in FIG. 8, embodiments are not limited this particular number of traffic states, or the particular traffic states illustrated in FIG. 8.

In the description above, for the purposes of explanation, numerous specific details are set forth in order to provide a thorough understanding of the described embodiments. It will be apparent, however, to one skilled in the art that embodiments may be practiced without some of these specific details. In other instances, well-known structures and devices are shown in block diagram form. There may be intermediate structure between illustrated components. The components described or illustrated herein may have additional inputs or outputs that are not illustrated or described.

Various embodiments may include various processes. These processes may be performed by hardware components or may be embodied in computer program or machine-executable instructions, which may be used to cause a general-purpose or special-purpose processor or logic circuits programmed with the instructions to perform the processes. Alternatively, the processes may be performed by a combination of hardware and software.

Portions of various embodiments may be provided as a computer program product, which may include a computer-readable medium having stored thereon computer program instructions, which may be used to program a computer (or other electronic devices) for execution by one or more processors to perform a process according to certain embodiments. The computer-readable medium may include, but is not limited to, magnetic disks, optical disks, compact disk read-only memory (CD-ROM), and magneto-optical disks, read-only memory (ROM), random access memory (RAM), erasable programmable read-only memory (EPROM), electrically-erasable programmable read-only memory (EEPROM), magnet or optical cards, flash memory, or other type of computer-readable medium suitable for storing electronic instructions. Moreover, embodiments may also be downloaded as a computer program product, wherein the program may be transferred from a remote computer to a requesting computer.

Many of the methods are described in their most basic form, but processes can be added to or deleted from any of the methods and information can be added or subtracted from any of the described messages without departing from the basic scope of the present embodiments. It will be apparent to those skilled in the art that many further modifications and adaptations can be made. The particular embodiments are not provided to limit the concept but to illustrate it. The scope of the embodiments is not to be determined by the specific examples provided above but only by the claims below.

If it is said that an element "A" is coupled to or with element "B," element A may be directly coupled to element B or be indirectly coupled through, for example, element C. When the specification or claims state that a component, feature, structure, process, or characteristic A "causes" a component, feature, structure, process, or characteristic B, it means that "A" is at least a partial cause of "B" but that there may also be at least one other component, feature, structure, process, or characteristic that assists in causing "B." If the specification indicates that a component, feature, structure, process, or characteristic "may", "might", or "could" be included, that particular component, feature, structure, process, or characteristic is not required to be included. If the specification or claim refers to "a" or "an" element, this does not mean there is only one of the described elements.

An embodiment is an implementation or example. Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. It should be appreciated that in the foregoing description of exemplary embodiments, various features are sometimes grouped together in a single embodiment, figure, or description thereof for the purpose of streamlining the disclosure and aiding in the understanding of one or more of the various novel aspects. This method of disclosure, however, is not to be interpreted as reflecting an intention that the claimed embodiments requires more features than are expressly recited in each claim. Rather, as the following claims reflect, novel aspects lie in less than all features of a single foregoing disclosed embodiment. Thus, the claims are hereby expressly incorporated into this description, with each claim standing on its own as a separate embodiment.

In some embodiments, a traffic sensor unit includes a processor; one or more sensors to sense motor vehicles; and one or more alert strobes; wherein the traffic sensor unit is to monitor sensor data generated by the one or more sensors and process the sensor data to detect a traffic condition; determine a traffic state of a plurality of traffic states based at least in part on the sensor data; and enable or disable one or more alert strobes based at least in part on the determined traffic state.

In some embodiments, the traffic sensor unit further includes a transmitter to transmit traffic alert messages to one or more other traffic sensors, wherein a traffic alert message is based at least in part on the sensor data.

In some embodiments, the traffic sensor unit further includes a receiver to receive traffic alert messages from the one or more other traffic sensor units, wherein the determination of the traffic state is further based on received traffic alert messages.

In some embodiments, a traffic alert message includes at least the following: an alert notice regarding a detected abnormal traffic condition; and a location of the abnormal traffic condition.

In some embodiments, the traffic sensor unit is further to broadcast a traffic advisory message for receipt of an electronic device within a motor vehicle.

In some embodiments, the one or more sensors include one or more of an infrared sensor or a magnetometer sensor.

In some embodiments, the plurality of traffic states includes a normal state and one or more alert traffic states. In some embodiments, the traffic sensor unit is to enable the alert strobe in the one or more alert traffic states and to disable the alert strobe in the normal traffic state.

In some embodiments, the one or more alert traffic states includes a warning traffic state and an emergency traffic state, the traffic sensor unit to enable a first alert strobe in the warning traffic state and a second alert strobe in the emergency traffic state.

In some embodiments, the traffic sensor unit is to detect a traffic condition based at least in part on a rate of change of the sensor data.

In some embodiments, the traffic sensor unit further includes a power production component to produce power for operation of the traffic sensor unit. In some embodiments, the power production component includes one or more of a solar cell, a component to produce power from vibration, and a component to produce power from heat.

In some embodiments, the traffic sensor unit further includes a device identification, wherein the traffic sensor unit is operable to provide the device identification in a message transmission.

In some embodiments, a system includes a plurality of traffic sensor units, wherein each of the plurality of traffic sensor units includes a processor; one or more sensors to sense motor vehicles; and one or more alert strobes; and wherein each traffic sensor unit of the plurality of traffic sensor units is to monitor sensor data generated by the one or more sensors and process the sensor data to detect traffic conditions; determine a traffic state of a plurality of traffic states based at least in part on the sensor data; and enable or disable one or more alert strobes based at least in part on the determined traffic state.

In some embodiments, one or more of the plurality of traffic sensor units further includes a transmitter to transmit traffic alert messages to one or more other traffic sensor units, wherein a traffic alert message is based at least in part on the sensor data.

In some embodiments, one or more of the plurality of traffic sensor units further includes a receiver to receive traffic alert messages from the one or more other traffic sensor units, wherein the determination of the traffic state is further based on received traffic alert messages.

In some embodiments, the system further includes a control station, the control station to wirelessly communicate with one or more of the plurality of traffic sensor units.

In some embodiments, each traffic sensor unit of the plurality of traffic sensor units is to operate independently as a standalone unit.

In some embodiments, the plurality of traffic states for one or more traffic sensor units of the plurality of traffic sensor units includes a normal state and one or more alert traffic states, wherein each of the one of more traffic sensor units is to enable the alert strobe in the one or more alert traffic states and to disable the alert strobe in the normal traffic state.

In some embodiments, a traffic sensor unit of the plurality of traffic sensor units is to detect a traffic condition based at least in part on a rate of change of the sensor data.

In some embodiments, each traffic sensor unit of the plurality of traffic sensor units further includes a unique device identification.

In some embodiments, a non-transitory computer-readable storage medium having stored thereon data representing sequences of instructions that, when executed by a processor, cause the processor to perform operations includes monitoring sensor data generated by one or more traffic sensors of a traffic sensor unit; processing the sensor data to identify a traffic condition; determining a traffic state of a plurality of traffic states based at least in part on the sensor data; and enabling or disabling one or more alert strobes of the traffic sensor unit based at least in part on the determined traffic state.

In some embodiments, the medium further includes instructions for transmitting a traffic alert message to one or more other traffic sensor units, wherein a traffic alert message is based at least in part on the sensor data. In some embodiments, the medium further includes instructions for receiving a traffic alert message from the one or more other traffic sensor units, wherein the determination of the traffic state is further based on the received traffic alert message.

In some embodiments, the detection of the traffic condition is based at least in part on a rate of change of the sensor data.

In some embodiments, an apparatus includes means for monitoring sensor data generated by one or more traffic sensors of a traffic sensor unit; means for processing the sensor data to identify a traffic condition; means for determining a traffic state of a plurality of traffic states based at least in part on the sensor data; and means for enabling or disabling one or more alert strobes of the traffic sensor unit based at least in part on the determined traffic state.

In some embodiments, the apparatus further includes means for transmitting a traffic alert message to one or more other traffic sensor units, wherein a traffic alert message is based at least in part on the sensor data. In some embodiments, the apparatus further includes means for receiving a traffic alert message from the one or more other traffic sensor units, wherein the determination of the traffic state is further based on the received traffic alert message.

In some embodiments, the detection of the traffic condition is based at least in part on a rate of change of the sensor data.

What is claimed is:

1. A traffic sensor unit comprising:
a processor;
one or more sensors to sense motor vehicles; and
one or more alert strobes;
wherein the traffic sensor unit is to:
monitor sensor data generated by the one or more sensors and process the sensor data to detect a traffic condition based at least in part on a rate of change of the sensor data;
determine a traffic state of a plurality of traffic states based at least in part on the sensor data; and
enable or disable one or more alert strobes based at least in part on the determined traffic state.

2. The traffic sensor unit of claim 1, further comprising a transmitter to transmit traffic alert messages to one or more other traffic sensors, wherein a traffic alert message is based at least in part on the sensor data.

3. The traffic sensor unit of claim 2, further comprising a receiver to receive traffic alert messages from the one or more other traffic sensor units, wherein the determination of the traffic state is further based on received traffic alert messages.

4. The traffic sensor unit of claim 2, wherein a traffic alert message includes at least the following:
an alert notice regarding a detected abnormal traffic condition; and
a location of the abnormal traffic condition.

5. The traffic sensor unit of claim 2, wherein the traffic sensor unit is further to broadcast a traffic advisory message for receipt of an electronic device within a motor vehicle.

6. The traffic sensor unit of claim 1, wherein the one or more sensors include one or more of an infrared sensor or a magnetometer sensor.

7. The traffic sensor unit of claim 1, wherein the plurality of traffic states includes a normal state and one or more alert traffic states.

8. The traffic sensor unit of claim 7, wherein the traffic sensor unit is to enable the alert strobe in the one or more alert traffic states and to disable the alert strobe in the normal traffic state.

9. The traffic sensor unit of claim 8, wherein the one or more alert traffic states includes a warning traffic state and an emergency traffic state, the traffic sensor unit to enable a first alert strobe in the warning traffic state and a second alert strobe in the emergency traffic state.

10. The traffic sensor unit of claim 1, further comprising a power production component to produce power for operation of the traffic sensor unit.

11. The traffic sensor unit of claim 10, wherein the power production component includes one or more of a solar cell, a component to produce power from vibration, and a component to produce power from heat.

12. The traffic sensor unit of claim 1, further comprising a device identification, wherein the traffic sensor unit is operable to provide the device identification in a message transmission.

13. A system comprising:
a plurality of traffic sensor units, wherein each of the plurality of traffic sensor units includes:
a processor;
one or more sensors to sense motor vehicles; and
one or more alert strobes; and
wherein each traffic sensor unit of the plurality of traffic sensor units is to:
monitor sensor data generated by the one or more sensors and process the sensor data to detect traffic conditions, including detecting a traffic condition based at least in part on a rate of change of the sensor data;
determine a traffic state of a plurality of traffic states based at least in part on the sensor data; and
enable or disable one or more alert strobes based at least in part on the determined traffic state.

14. The system of claim 13, wherein one or more of the plurality of traffic sensor units further includes a transmitter to transmit traffic alert messages to one or more other traffic sensor units, wherein a traffic alert message is based at least in part on the sensor data.

15. The system of claim 14, wherein one or more of the plurality of traffic sensor units further includes a receiver to receive traffic alert messages from the one or more other traffic sensor units, wherein the determination of the traffic state is further based on received traffic alert messages.

16. The system of claim 13, further comprising a control station, the control station to wirelessly communicate with one or more of the plurality of traffic sensor units.

17. The system of claim 14, wherein each traffic sensor unit of the plurality of traffic sensor units is to operate independently as a standalone unit.

18. The system of claim 14, wherein the plurality of traffic states for one or more traffic sensor units of the plurality of traffic sensor units includes a normal state and one or more alert traffic states, wherein each of the one of more traffic sensor units is to enable the alert strobe in the one or more alert traffic states and to disable the alert strobe in the normal traffic state.

19. The system of claim 14, wherein each traffic sensor unit of the plurality of traffic sensor units further includes a unique device identification.

20. A non-transitory computer-readable storage medium having stored thereon data representing sequences of instructions that, when executed by a processor, cause the processor to perform operations comprising:
monitoring sensor data generated by one or more traffic sensors of a traffic sensor unit;
processing the sensor data to detect a traffic condition based at least in part on a rate of change of the sensor data;
determining a traffic state of a plurality of traffic states based at least in part on the sensor data; and enabling or disabling one or more alert strobes of the traffic sensor unit based at least in part on the determined traffic state.

21. The medium of claim 20, further comprising instructions that, when executed by the processor, cause the processor to perform operations comprising:

transmitting a traffic alert message to one or more other traffic sensor units, wherein a traffic alert message is based at least in part on the sensor data.

22. The medium of claim 21, further comprising instructions that, when executed by the processor, cause the processor to perform operations comprising:

receiving a traffic alert message from the one or more other traffic sensor units, wherein the determination of the traffic state is further based on the received traffic alert message.

23. The medium of claim 20, wherein the detection of the traffic condition is based at least in part on a rate of change of the sensor data.

* * * * *